US007931071B2

(12) United States Patent
Muramatsu et al.

(10) Patent No.: US 7,931,071 B2
(45) Date of Patent: Apr. 26, 2011

(54) HEAT EXCHANGER WITH HEAT PIPE

(75) Inventors: Kenshirou Muramatsu, Nishio (JP); Yasutoshi Yamanaka, Kariya (JP); Masashi Miyagawa, Ichinomiya (JP); Kazuaki Kafuku, Chiryu (JP)

(73) Assignee: Denso Corporation, Kariya (JP)

( * ) Notice: Subject to any disclaimer, the term of this patent is extended or adjusted under 35 U.S.C. 154(b) by 852 days.

(21) Appl. No.: 11/895,243

(22) Filed: Aug. 23, 2007

(65) Prior Publication Data

US 2008/0047690 A1 Feb. 28, 2008

(30) Foreign Application Priority Data

Aug. 25, 2006 (JP) ..... 2006-228966
Jul. 25, 2007 (JP) ..... 2007-193143

(51) Int. Cl.
*F28D 15/02* (2006.01)

(52) U.S. Cl. ..... 165/104.14; 165/166

(58) Field of Classification Search ..... 165/104.14, 165/104.21, 166
See application file for complete search history.

(56) References Cited

U.S. PATENT DOCUMENTS 5,529,115 A * 6/1996 Paterson ..... 165/104.33
5,695,004 A * 12/1997 Beckwith ..... 165/104.21
5,806,583 A * 9/1998 Suzuki et al. ..... 165/104.33
5,983,992 A * 11/1999 Child et al. ..... 165/81
2006/0180074 A1 8/2006 Hayashi

FOREIGN PATENT DOCUMENTS

| | | |
|---|---|---|
| JP | 60-148879 | 10/1985 |
| JP | 62-268722 | 11/1987 |
| JP | 3-21680 | 3/1991 |
| JP | 04-045393 | 2/1992 |

OTHER PUBLICATIONS

Office action dated Mar. 13, 2009 in Chinese Application No. 2007 10142496.6.

* cited by examiner

*Primary Examiner* — Teresa J Walberg
(74) *Attorney, Agent, or Firm* — Harness, Dickey & Pierce, PLC

(57) ABSTRACT

A heat exchanger includes an evaporation side heat pipe in which a working fluid flowing therein is heat exchanged with a high-temperature fluid to be evaporated, a condensation side heat pipe in which the working fluid flowing therein is heat exchanged with a low-temperature fluid to be condensed, and an inner fin located at least in the evaporation side heat pipe to increase a heat transmission area of the evaporation side heat pipe with the working fluid. The evaporation side heat pipe and the condensation side heat pipe are connected to form a closed cycle, and the evaporation side heat pipe is arranged such that the working fluid flows in the evaporation side heat pipe in a direction different from a horizontal direction. Furthermore, the inner fin has a bottom end that is positioned above a top surface of the working fluid at least in a liquid state.

25 Claims, 6 Drawing Sheets

HEAT EXCHANGER WITH HEAT PIPE

CROSS REFERENCE TO RELATED APPLICATION

This application is based on Japanese Patent Applications No. 2006-228966 filed on Aug. 25, 2006, and No. 2007-193143 filed on Jul. 25, 2007, the contents of which are incorporated herein by reference in its entirety.

BACKGROUND OF THE INVENTION

1. Field of the Invention

The present invention relates to a heat exchanger with a heat pipe.

2. Description of the Related Art

JP-A-4-45393 describes a heat exchanger using a loop type heat pipe, which is used for a hot water supply system. In the heat exchanger using the loop type heat pipe, a working fluid is circulated in a closed loop circuit to be evaporated and to be condensed. The working fluid is evaporated in an evaporation portion by absorbing heat from a thermal storage material, and is condensed in a condensation portion by radiating heat to water. In this heat exchanger, lower end portions of plural heat pipes communicate with each other by a lower communication portion (lower header), such that the working fluid condensed in the condensation portion flows into the plural heat pipes via the lower communication portion.

Furthermore, in a heat-pipe type heat exchanger, inner fins are located within heat pipes in order to increase a heat transmission area between the heat pipes and a working fluid and to improve pressure-resisting strength. Alternatively, in a case where inner fins are not provided in a heat-pipe type heat exchanger in which plural heat pipes are stacked and brazed, ribs are formed to improve brazing performance and pressure-resisting strength. Specifically, the heat pipe is provided with an inner fluid passage by oppositely arranging a first flat plate and a second flat plate, and the ribs protruding to the inner fluid passage are formed in the first flat plate and the second flat plate to contact at its tip ends.

The heat-pipe type heat exchanger is generally used for recovering heat of exhaust gas of an internal combustion engine of a vehicle so as to improve an engine-heating performance by using the exhaust heat. The temperature of exhaust gas may be increased to 900° C. in maximum. In contrast, water is normally used as the working fluid, and water is solidified (freeze) so that the volume expansion of about 9% is caused as compared with that in a liquid state. However, when water is used as the working fluid, the following problems may be caused.

For example, in a case where water is used as the working fluid in a heat exchanger having heat pipes provided with inner fins, when the working fluid is solidified at a low temperature condition such as the freeze point, the solidification of the working fluid starts firstly at portions contacting the heat pipes, the lower communication portion and the inner fins. FIG. 11 shows a heat-pipe type heat exchanger 300A including a heat pipe 303*a*, inner fins 308 located in the heat pipe 303*a*, and a lower communication portion 305*b*. As shown in FIG. 11, when liquid working fluid B is closed by solid working fluid A in accordance with progress of the solidification of the working fluid, inner pressure of the heat exchanger 300A is increased by solidification of the closed liquid working fluid B thereby pressure applied to the heat pipe 303*a* and the lower communication portion 305*b* is increased. When the top surface of the working fluid contacts the inner fins 308, the liquid working fluid B closed in the solid working fluid A becomes larger because the top portion of the working fluid contacting the inner fins 308 is solidified at an early time in the solidification process. In this case, the inner pressure applied to the heat pipe 303*a* and the lower communication portion 305*b* will be further increased if the liquid working fluid B closed by the solid working fluid A is solidified.

SUMMARY OF THE INVENTION

In view of the foregoing problems, it is an object of the present invention to provide a heat exchanger having an inner fin or ribs in a heat pipe, which can reduce inner pressure due to solidification of a working fluid thereby improving durability of the heat exchanger.

It is another object of the present invention to provide a heat exchanger having a heat-transmission area increasing member located in heat pipes, in which a bottom end of the heat-transmission area increasing member is positioned above a top surface of working fluid at least in a liquid state.

According to an aspect of the present invention, a heat exchanger includes an evaporation side heat pipe in which a working fluid flowing therein is heat exchanged with an exterior high-temperature fluid passing therethrough to be evaporated, a condensation side heat pipe in which the working fluid flowing therein is heat exchanged with an exterior low-temperature fluid passing therethrough to be condensed, and an evaporation side inner fin located in the evaporation side heat pipe to increase a heat transmission area of the evaporation side heat pipe with the working fluid. In the heat exchanger, the evaporation side heat pipe and the condensation side heat pipe are connected to form a closed cycle in which the working fluid circulates between the evaporation side heat pipe and the condensation side heat pipe, the evaporation side heat pipe is arranged such that the working fluid flows in the evaporation side heat pipe in a direction different from a horizontal direction, and the evaporation side inner fin located in the evaporation side heat pipe has a bottom end that is positioned above a top surface of the working fluid in a liquid state.

Thus, at a solidification start time of the working fluid, because the top surface of the working fluid does not contact the inner fin in the evaporation side heat pipes, heat transmission is slowly performed at the top surface of the working fluid, and the solidification of the working fluid at its top surface becomes later. Therefore, at the time where the top surface of the working fluid is solidified and closed, an amount of the liquid working fluid closed and sealed by the solid working fluid becomes smaller, thereby reducing an inner pressure due to the solidification of the liquid working fluid. Accordingly, the durability of the heat exchanger can be improved.

For example, the evaporation side heat pipe and the condensation side heat pipe may be arranged in an arrangement direction that is approximately parallel to the horizontal direction, and the condensation side heat pipe may be arranged such that the working fluid flows in the condensation side heat pipe in a direction different from the horizontal direction. Furthermore, a condensation side inner fin may be located in the condensation side heat pipe to increase a heat transmission area of the condensation side heat pipe with the working fluid. In this case, the condensation side inner fin located in the condensation side heat pipe has a bottom end that is positioned above a top surface of the working fluid in the liquid state within the condensation side heat pipe. Accordingly, at a solidification start time of the working fluid, the top surface of the working fluid does not contact the condensation side inner fin in the condensation side heat pipes, heat transmission is slowly performed at the top surface of the working fluid, and the solidification of the working fluid at its top surface can be made later. Therefore, at the time where the top surface of the working fluid is solidified and closed, an amount of the liquid working fluid closed and sealed by the solid working fluid becomes smaller, thereby reducing an inner pressure due to the solidification of the liquid working fluid. Thus, the durability of the heat exchanger can be improved.

The bottom end of the evaporation side inner fin or the condensation side inner fin may be positioned above a top surface of the working fluid in a solid state. In this case, the inner pressure generated due to the solidification of the working fluid can be further reduced in the heat exchanger.

According to another aspect of the present invention, a heat exchanger includes a heat pipe elongated in a longitudinal direction and closed at its longitudinal ends to have a working fluid sealed therein, and an inner fin located in the heat pipe to increase a heat transmission area of the heat pipe with the working fluid. Furthermore, the heat pipe has a first portion on one side of the longitudinal direction and a second portion on the other side of the longitudinal direction, the first portion of the heat pipe is located to evaporate the working fluid by heat-exchanging between the working fluid and an exterior high-temperature fluid, the second portion of the heat pipe is located to condense the evaporated working fluid, the heat pipe is arranged such that the working fluid flows in the heat pipe in a direction different from a horizontal direction, and the inner fin located in the heat pipe has a bottom end that is positioned above a top surface of the working fluid in a liquid state. Accordingly, at a solidification start time of the working fluid, the top surface of the working fluid does not contact the inner fin in the heat pipe, heat transmission is slowly performed at the top surface of the working fluid, and the solidification of the working fluid at its top surface becomes later. Therefore, at the time where the top surface of the working fluid is solidified and closed, an amount of the liquid working fluid closed and sealed by solid working fluid becomes smaller, thereby reducing an inner pressure due to the solidification of the liquid working fluid. For example, the heat pipe may be a straight pipe.

According to another aspect of the present invention, a heat exchanger includes an evaporation side heat pipe in which a working fluid flowing therein is heat exchanged with an exterior high-temperature fluid passing therethrough to be evaporated, and a condensation side heat pipe in which the working fluid flowing therein is heat exchanged with an exterior low-temperature fluid passing therethrough to be condensed. Furthermore, the evaporation side heat pipe and the condensation side heat pipe are connected to form a closed cycle in which the working fluid circulates between the evaporation side heat pipe and the condensation side heat pipe, and the evaporation side heat pipe is arranged such that the working fluid flows in the evaporation side heat pipe in a direction different from a horizontal direction. In addition, the evaporation side heat pipe includes a first flat plate, a second flat plate opposite to the first flat plate to form an inner fluid passage between the first flat plate and the second flat plate, in which the working fluid flows, and ribs provided in the first flat plate and the second flat plate to protrude into the inner fluid passage. In the heat exchanger, the ribs of the first flat plate and the second flat plate, opposite to each other, are joined to each other at its top ends, and the ribs are positioned above a top surface of the working fluid in a liquid state. Accordingly, at a solidification start time of the working fluid, the top surface of the working fluid does not contact the ribs, thereby the solidification of the working fluid at its top surface can be made later.

According to another aspect of the present invention, a heat exchanger includes a heat pipe elongated in a longitudinal direction and closed at its longitudinal ends to have a working fluid sealed therein. The heat pipe has a first portion on one side of the longitudinal direction, and a second portion on the other side of the longitudinal direction. The first portion of the heat pipe is located to evaporate the working fluid by heat-exchanging between the working fluid and an exterior high-temperature fluid, the second portion of the heat pipe is located to condense the evaporated working fluid, and the heat pipe is arranged such that the working fluid flows in the heat pipe in a direction different from a horizontal direction. In addition, the heat pipe includes a first flat plate, a second flat plate opposite to the first flat plate to form an inner fluid passage between the first flat plate and the second flat plate, in which the working fluid flows, and ribs provided in the first flat plate and the second flat plate to protrude into the inner fluid passage. In this heat exchanger, the ribs of the first flat plate and the second flat plate, opposite to each other, are joined to each other at its top ends, and the ribs are positioned above a top surface of the working fluid in a liquid state. Accordingly, at a solidification start time of the working fluid, the top surface of the working fluid does not contact the ribs, thereby the solidification of the working fluid at its top surface can be made later.

According to another aspect of the present invention, a heat exchanger includes an evaporation portion located to heat and evaporate a working fluid, and a condensation portion located to cool and condense the evaporated working fluid. In the heat exchanger, at least one of the evaporation portion and the condensation portion includes a plurality of heat pipes in which the working fluid flows, the evaporation portion and the condensation portion are connected to form a closed cycle in which the working fluid circulates between the evaporation portion and the condensation portion, the heat pipes are arranged such that the working fluid flows in the heat pipes in a direction different from a horizontal direction, the evaporation portion further includes a heat-transmission area increasing member located in each of the heat pipes to increase a heat transmission area of the heat pipe with the working fluid, and the heat-transmission area increasing member is located at a position separated from a top surface of the working fluid in a liquid state in a vertical direction. Accordingly, at a solidification start time of the working fluid, the top surface of the working fluid does not contact the heat-transmission area increasing member in the heat pipes, thereby heat transmission is slowly performed at the top surface of the working fluid, and the solidification of the working fluid at its top surface becomes later. Therefore, at a time where the top surface of the working fluid is solidified and closed, an amount of the liquid working fluid closed and sealed by solid working fluid becomes smaller, thereby reducing an inner pressure due to the solidification of the liquid working fluid. Accordingly, the durability of the heat exchanger can be improved.

For example, the heat-transmission area increasing member may be located in the heat pipe at a position upper than a top surface of the working fluid in a solid state, or lower than the top surface of the working fluid in the liquid state. Furthermore, the heat-transmission area increasing member may be an inner fin located inside the heat pipe, or may be ribs protruding from an inner wall surface of the heat pipe inside of the heat pipe.

BRIEF DESCRIPTION OF THE DRAWINGS

Additional objects and advantages of the present invention will be more readily apparent from the following detailed description of preferred embodiments when taken together with the accompanying drawings. In which.

DETAILED DESCRIPTION OF THE PREFERRED EMBODIMENTS

First Embodiment

A first embodiment of the present invention will be now described with reference to FIGS. 1-4. In this embodiment, a heat exchanger 300 is typically used for recovering exhaust heat of exhaust gas of a water-cooled engine of a vehicle, and for heating engine-cooling water (coolant). The hot water (engine-cooling water) heated by the heat exchanger 300 may be used as a heat source for heating air in an air conditioner.

Figure 1:
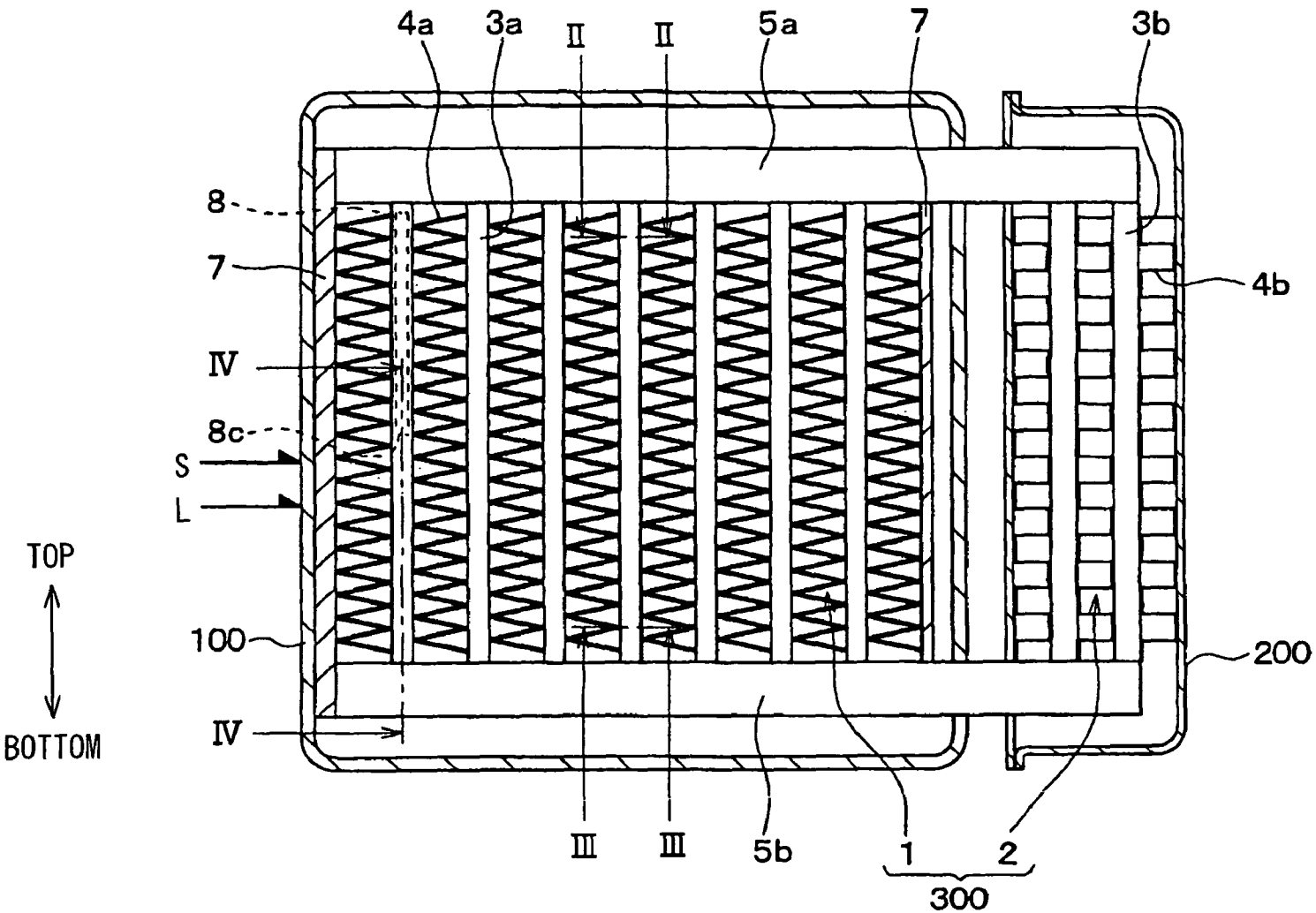
FIG. 1 is a schematic front view showing a heat-pipe type heat exchanger when being viewed from an upstream side of exhaust gas, according to a first embodiment of the present invention.

As shown in FIG. 1, the heat exchanger 300 is provided with an evaporation portion 1 and a condensation portion 2 which are arranged adjacent to each other in an arrangement direction that is approximately parallel to a horizontal direction.

The evaporation portion 1 is located within a cylindrical first box 100 in which exhaust gas having a high temperature from an engine flows. The cylindrical first box 100 is, for example, disposed in an exhaust cylinder of the engine. The evaporation portion 1 is constituted such that the exhaust gas is heat exchanged with a working fluid so as to heat and evaporate the working fluid.

The evaporation portion 1 includes a plurality of evaporation side heat pipes 3*a*. Each of the evaporation side heat pipes 3*a* is formed into a flat shape in a cross-section having a major dimension in a direction (face-back direction in the paper of FIG. 1) corresponding to a flow direction of exhaust gas in the first box 100. The evaporation side heat pipes 3*a* are arranged such that the longitudinal direction of the evaporation side heat pipes 3*a* substantially corresponds to a vertical direction. Corrugated fins 4*a* are bonded to outside flat surfaces of the evaporation side heat pipes 3*a*, so that heat transmission areas with the exhaust gas can be increased by the corrugated fins 4*a*. Therefore, by providing the corrugated fins 4*a*, heat exchanging performance between the working fluid and the exhaust gas can be facilitated.

The condensation portion 2 is located in a second box 200 in which engine-cooling water having a relative low temperature flows. The second box 200 can be located in a water circuit in which engine-cooling water (coolant) circulates to cool the engine. In the condensation portion 2, the working fluid evaporated in the evaporation portion 1 and the engine-cooling water is heat exchanged so that the evaporated working fluid is condensed and the engine-cooling water is heated.

The condensation portion 2 includes a plurality of condensation side heat pipes 3*b*. Each of the condensation side heat pipes 3*b* is formed into a flat shape in a cross-section having a major dimension in a direction (face-back direction in the paper of FIG. 1) corresponding to a flow direction of the engine-cooling water in the second box 200. The condensation side heat pipes 3*b* are arranged such that the longitudinal direction of the condensation side heat pipes 3*b* corresponds to the longitudinal direction of the evaporation side heat pipes 3*a*. That is, the longitudinal direction of the condensation side heat pipes 3*b* is arranged in parallel with the longitudinal direction of the evaporation side heat pipes 3*a*. Straight fins 4*b* are bonded to flat surfaces of the condensation side heat pipes 3*b*, so that heat transmission areas with the engine-cooling water can be increased by the straight fins 4*b*. Therefore, by providing the straight fins 4*b*, heat exchanging performance between the working fluid and the engine-cooling water can be facilitated in the condensation portion 2.

A pair of communication portions 5*a*, 5*b* are provided at longitudinal end sides of the heat pipes 3*a*, 3*b* to communicate with the heat pipes 3*a*, 3*b* at both end sides of the heat pipes 3*a*, 3*b*. The pair of the communication portions 5*a*, 5*b* are disposed to form a part of the evaporation portion 1 and a part of the condensation portion 2. In the communication portions 5*a*, 5*b* at both end sides of the heat pipes 3*a*, 3*b*, the one positioned at the upper side of the heat pipes 3*a*, 3*b* in the vertical direction is an upper communication portion 5*a*, and the other one positioned at the lower side of the heat pipes 3*a*, 3*b* in the vertical direction is a lower communication portion 5*b*.

The heat pipes 3*a*, 3*b* and the pair of the communication portions 5*a*, 5*b* are constituted to form a closed loop-type cycle. In the closed loop-type cycle, working fluid (e.g., refrigerant, water) is sealed therein to be evaporated and condensed. In this embodiment, water is used as the working fluid, as an example. The amount of the working fluid sealed in the closed loop-type cycle is set such that the liquid surface of the working fluid is positioned above the lower communication portion 5*b*. In FIG. 1, L indicates the top surface position (water surface) of the working fluid in a liquid state, and S indicates the top surface position of the working fluid in a solid state.

Side plates 7 for reinforcing the evaporation portion 1 are provided at two sides of the evaporation portion 1, to extend approximately in parallel with the longitudinal direction of the evaporation side heat pipe 3*a*.

Figure 2:
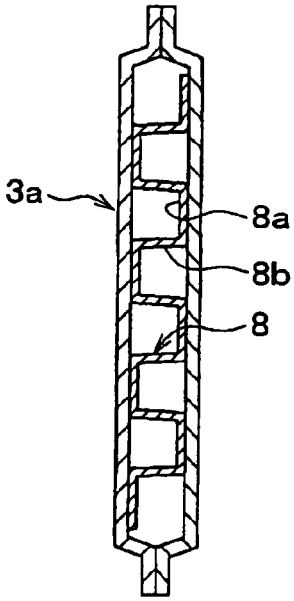
FIG. 2 is a cross-sectional view taken along the line II-II in FIG. 1.
Figure 3:
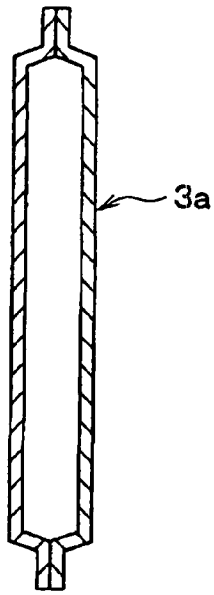
FIG. 3 is a cross-sectional view taken along the line III-III in FIG. 1.

As shown in FIG. 2, inner fins 8 are located at upper portions in the evaporation side heat pipes 3*a* so as to increase heat transmission areas with the working fluid. In contrast, as shown in FIG. 3, no inner fin is provided at lower portions in the evaporation side heat pipes 3*a*.

For example, the bottom end 8*c* of the inner fin 8 is positioned upper than the top surface position L of the working fluid in the liquid state. Furthermore, the bottom end 8*c* of the inner fin 8 is positioned upper than the top surface position S of the working fluid in the solid state, in this embodiment, as shown in FIG. 1.

The inner fin 8 is formed by bending a plate member to have tip portions 8*a* and flat plate portions 8*b* which are alternately formed. The inner fin 8 is formed such that the tip portions 8*a* of the inner fin 8 contact inner walls of the evaporation side heat pipe 3*a*, and the flat plate portions 8*b* extend to opposite inner walls of the evaporation side heat pipe 3*a*.

Inner fins (not shown) may be provided at an upper portion within the condensation side heat pipe 3*b* in the vertical direction, similarly to the structure of the inner fins 8 of the evaporation side heat pipes 3*a*. In this case, the bottom ends of the inner fins of the condensation side heat pipes 3*b* can be positioned upper than the top surface position L of the working fluid in the liquid state, similarly to the evaporation side heat pipe 3*a*. Furthermore, the bottom end of the inner fins of the condensation side heat pipes 3*b* can be positioned upper than the top surface position S of the working fluid in the solid state, similarly to the structure of the evaporation side heat pipes 3*a*.

Next, operation of the heat exchanger 300 of the first embodiment with the above structure will be now described. In the heat exchanger 300 of the first embodiment, while exhaust gas passes through the evaporation portion 1 in the first box 100, the liquid working fluid within the evaporation side heat pipes 3*a* is evaporated by absorbing heat from the exhaust gas, such that the evaporated vapor-phase working fluid flows into the condensation portion 2 via the upper communication portion 5*a*. The evaporated vapor working fluid flowing into the condensation side heat pipe 3*b* is cooled and condensed by the engine-cooling water flowing in the second box 200, and the condensed working fluid flows into the evaporation portion 1 via the lower communication portion 5*b*. Accordingly, the working fluid is circulated in the heat pipes 3*a*, 3*b* and the communication portions 5*a*, 5*b* connected in a closed loop, thereby the exhaust heat from the exhaust gas of the engine is recovered to heat the engine-cooling water.

In a case where the exhaust gas does not pass through the evaporation portion 1 in the first box 100, if the outside air temperature becomes lower than the freeze temperature, the working fluid staying at the lower portion in the heat pipes 3*a*, 3*b* and the lower communication portion 5*b* is solidified.

Figure 4:
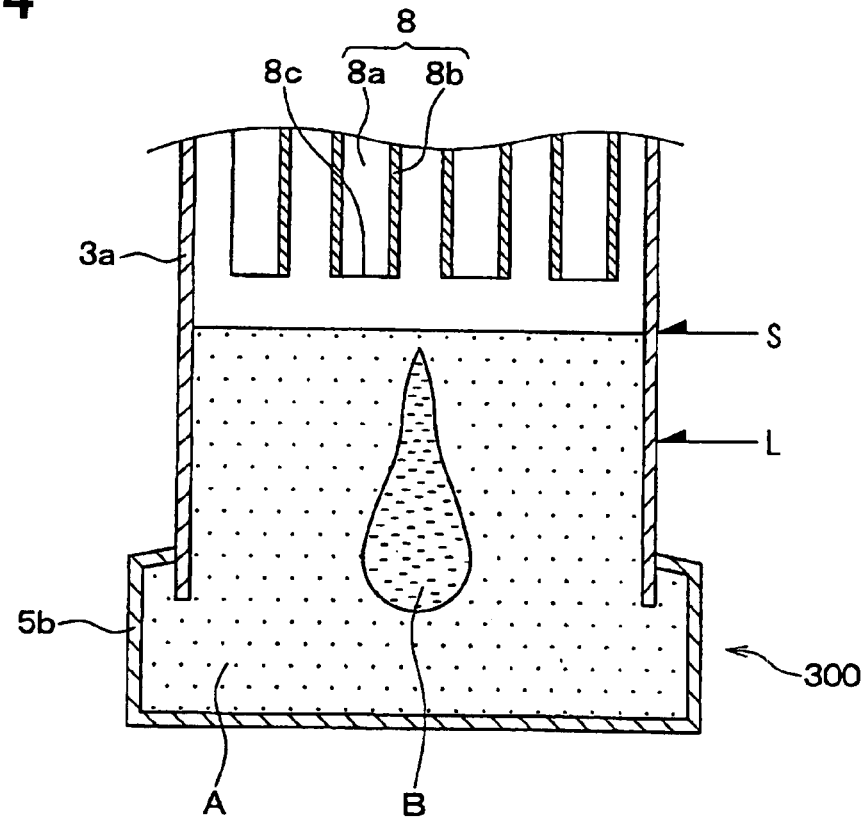
FIG. 4 is a cross-sectional view taken along the line IV-IV in FIG. 1.

At a solidification start time of the working fluid, because the top surface of the working fluid does not contact the inner fins 8, the heat transmission is slowly performed at the top surface of the working fluid, and the solidification of the working fluid at the top surface can be made later. In contrast, at the portions contacting the heat pipes 3*a*, 3*b* and the lower communication portion 5*b*, the working fluid solidifies relatively early as compared with the top surface of the working fluid. Therefore, the timing, at which the top surface of the working fluid is solidified, becomes later. As a result, as shown in FIG. 4, at the time where the top surface of the working fluid is closed by the solid working fluid, an amount of the liquid working fluid B closed and sealed by solid working fluid A becomes smaller, thereby reducing an inner pressure due to the solidification of the liquid working fluid B. Thus, the durability of the heat exchanger 300 can be improved.

According to the first embodiment, the bottom ends 8*c* of the inner fins 8 are positioned above the top surface position S of the working fluid at the solid state. Thus, even when the top surface of the working fluid increases in accordance with the progress of the solidification of the working fluid, the top surface of the working fluid does not contact the inner fins 8. Because the top surface of the working fluid does not contact the inner fins 8, the solidification of the working fluid at the top surface can be made relatively slowly as compared with a case where the top surface of the working fluid contacts the inner fins 8.

Second Embodiment

Figure 5:
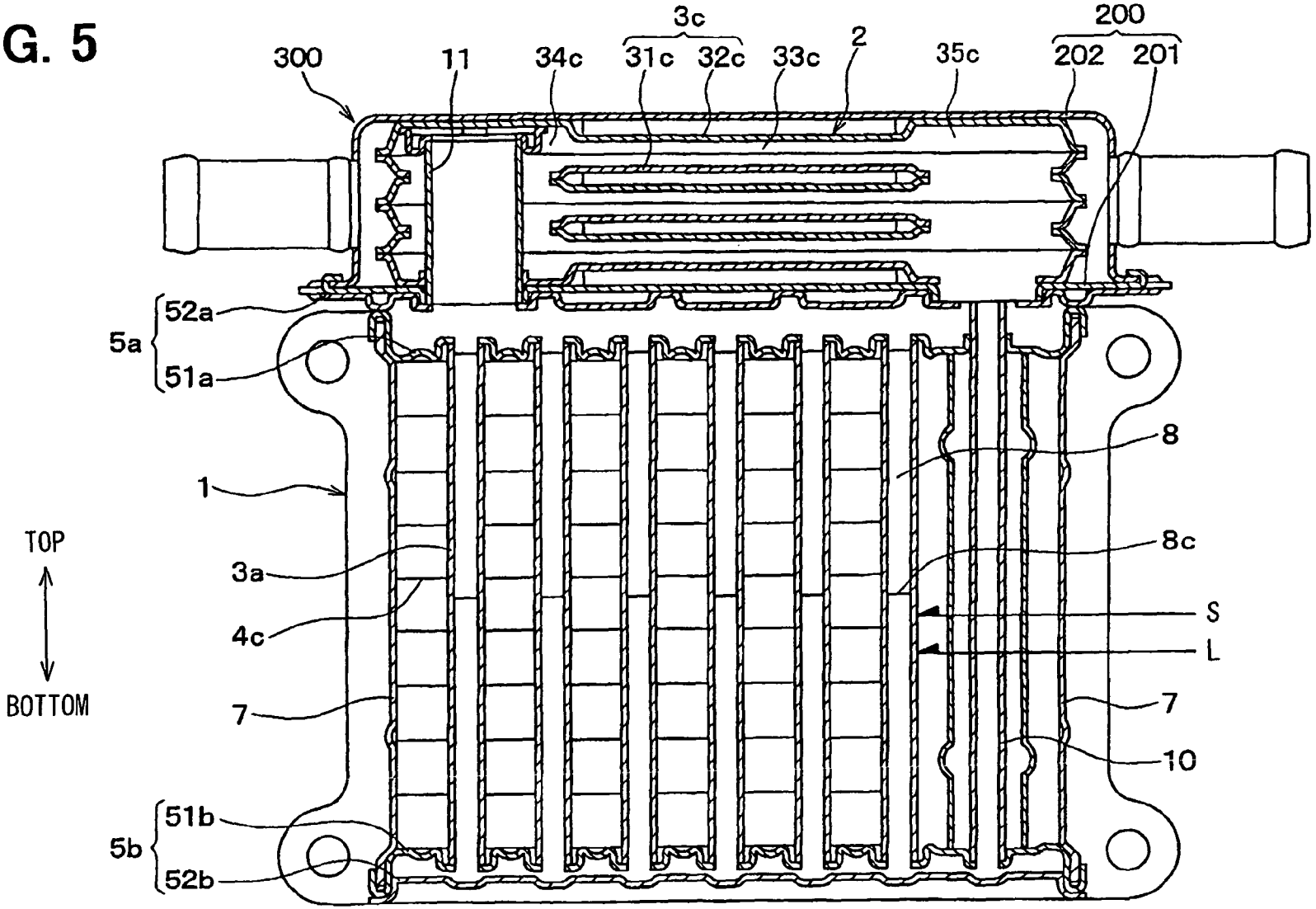
FIG. 5 is a schematic front view showing a heat-pipe type heat exchanger when being viewed from an upstream side of exhaust gas, according to a second embodiment of the present invention.

The second embodiment of the present invention will be now described with reference to FIG. 5. FIG. 5 shows a heat exchanger 300 according to the second embodiment. In the heat exchanger 300 of FIG. 5, the parts having the same function as those of the first embodiment are indicated by the same reference numbers.

In the above-described heat exchanger 300 of the first embodiment, the evaporation portion 1 and the condensation portion 2 are arranged in the arrangement direction approximately parallel to the horizontal direction. That is, the heat pipes 3*a* are arranged in parallel with the heat pipes 3*b*, and the upper and lower communication portions 5*a*, 5*b* are arranged to extend approximately perpendicular to the extending direction of the heat pipes 3*a*, 3*b*, in the above-described first embodiment.

In contrast, in a heat exchanger 300 of the second embodiment, a condensation portion 2 is arranged at an upper side of an evaporation portion 1, as shown in FIG. 5. As shown in FIG. 5, in the heat exchanger 300 of the second embodiment, evaporation side heat pipes 3*a* of the evaporation portion 1, condensation side heat pipes 3*c* of the condensation portion 2, and a return pipe 10 are connected in this order so as to form a closed cycle of a loop-type heat exchanger. In this embodiment, as the working fluid, water is sealed in the closed cycle, as an example.

Plate-type fins 4*c* formed from a thin plate material are joined to outer wall surfaces of the evaporation side heat pipes 3*a*. Upper and lower plates 51*a*, 51*b* have plural through holes at positions corresponding to the evaporation side heat pipes 3*a*, and are located at upper and lower end sides of the evaporation side heat pipes 3*a*.

The lower plate 51*b* is located at the lower end side of the evaporation side heat pipes 3*a* so that the through holes of the lower plate 51*b* correspond to the ends of the evaporation side heat pipes 3*a*. A lower tank plate 52*b* is joined to the lower plate 51*b* to be opposite to the bottom ends of the evaporation side heat pipes 3*a*. Therefore, a lower communication portion 5*b* is constructed by joining the lower tank plate 52*b* and the lower tank 51*b*.

Similarly, the upper plate 51*a* is located at the upper end side of the evaporation side heat pipes 3*a* so that the through holes of the upper plate 51*a* correspond to the ends of the evaporation side heat pipes 3*a*. An upper tank plate 52*a* is joined to the upper plate 51*a* to be opposite to the upper ends of the evaporation side heat pipes 3*a*. Therefore, an upper communication portion 5*a* is constructed by joining the upper tank plate 52*a* and the upper plate 51*a*.

A second box 200 for accommodating the condensation side heat pipes 3*c* can be formed by a flat water tank plate 201 and a water tank portion 202 having approximately a U-shaped cross section. The second box 200 is arranged at a top side of the evaporation portion 1 to be lie on the evaporation portion 1. The condensation portion 2 is located within the second box 200 such that the condensation portion 2 is arranged at the top side of the evaporation portion 1 and the condensation side heat pipes 3*c* extend in a direction approximately perpendicular to the extending direction of the evaporation side heat pipes 3*a*.

The condensation side heat pipes 3*c* constitute a drawn-cup type heat exchanger. For example, the condensation side heat pipe 3*c* is constructed by joining two plates 31*c*, 32*c* so as to form a tube shape. Plural tube-shaped heat pipes 3*c* are stacked so as to form a fluid flow portion 33*c* and tank portions 34*c*, 35*c* at two end sides of the heat pipes 3*c* in the longitudinal direction of the heat pipes 3*c*. The tank portions 34*c*, 35*c* form communication passages extending in the stacking direction of the condensation side heat pipes 3*c*, and communicate with the fluid flow portions 33*c* through communication holes.

A vapor gas introduction pipe 11 is located in the tank portion 34*c* to extend in the stacking direction, such that one end (lower end) of the vapor gas introduction pipe 11 is open in the upper communication portion 5*a* and the other end (upper end) is open at an area close to the top wall of the tank portion 34*c*. Therefore, via the vapor gas introduction pipe 11, the upper communication portion 5*a* communicates with the upper side area of the tank portion 34*c*, the inside of the tank portion 34*c*, the fluid flow portions 33*c* of the condensation side heat pipes 3*c*, and the tank portion 35*c*.

The return pipe 10 is located to penetrate the upper communication portion 5*a* of the evaporation portion 1, such that one end (upper end) of the return pipe 10 communicates with the tank portion 35*c* of the condensation portion 2, and the other end (lower end) of the return pipe 10 communicates with the lower communication portion 5*b* of the evaporation portion 1.

Similarly to the above-described first embodiment, the inner fins 8 are located at the upper portions in the evaporation side heat pipes 3*a* in the vertical direction, such that the bottom ends 8*c* of the inner fins 8 are positioned above the top surface position L of the working fluid in the liquid state, and above the top surface position S of the working fluid in the solid state. In contrast, the condensation side heat pipes 3*c* do not have therein an inner fin.

According to the heat exchanger 300 of the second embodiment, while the exhaust gas passes through the evaporation portion 1, the liquid working fluid within the evaporation side heat pipes 3*a* is evaporated by absorbing heat from the exhaust gas, and the evaporated vapor working fluid flows into the condensation portion 2 via the upper communication portion 5*a*. The vapor working fluid flowing into the condensation side heat pipes 3*c* is cooled and condensed by engine-cooling water, and the condensed liquid working fluid flows into the lower communication portion 5*b* via the return pipe 10, and then flows into the evaporation portion 1 via the lower communication portion 5*b*.

In a case where the exhaust gas does not pass through the evaporation portion 1, if the outside air temperature becomes lower than the freeze temperature of the working fluid, the working fluid staying at the lower portion in the heat pipes 3*a*, and the lower communication portion 5*b* is solidified.

At a solidification start time of the working fluid, because the top surface of the working fluid does not contact the inner fins 8, the heat transmission is slowly performed, and the solidification of the working fluid at its top surface becomes later. In contrast, at the portions contacting the heat pipes 3*a* and the lower communication portion 5*b*, the working fluid solidifies relatively early as compared with the top surface of the working fluid. Therefore, the timing, at which the top surface of the working fluid is solidified to be closed, becomes later. As a result, at the time where the top surface of the working fluid is closed by the solid working fluid, an amount of the liquid working fluid closed and sealed by the solid working fluid becomes smaller, thereby reducing an inner pressure due to the solidification of the liquid working fluid. Thus, the durability of the heat exchanger 300 can be improved, similarly to the above-described first embodiment.

According to the second embodiment, the bottom ends 8*c* of the inner fins 8 are positioned upper than the top surface position S of the working fluid at the solid state. Thus, even when the top surface of the working fluid increases in accordance with the solidification of the working fluid, the top surface of the working fluid does not contact the inner fins 8. Because the top surface of the working fluid does not contact the inner fins 8, the solidification of the working fluid at the top surface can be made relatively slowly as compared with a case where the top surface of the working fluid contacts the inner fins 8.

Third Embodiment

Figure 6:
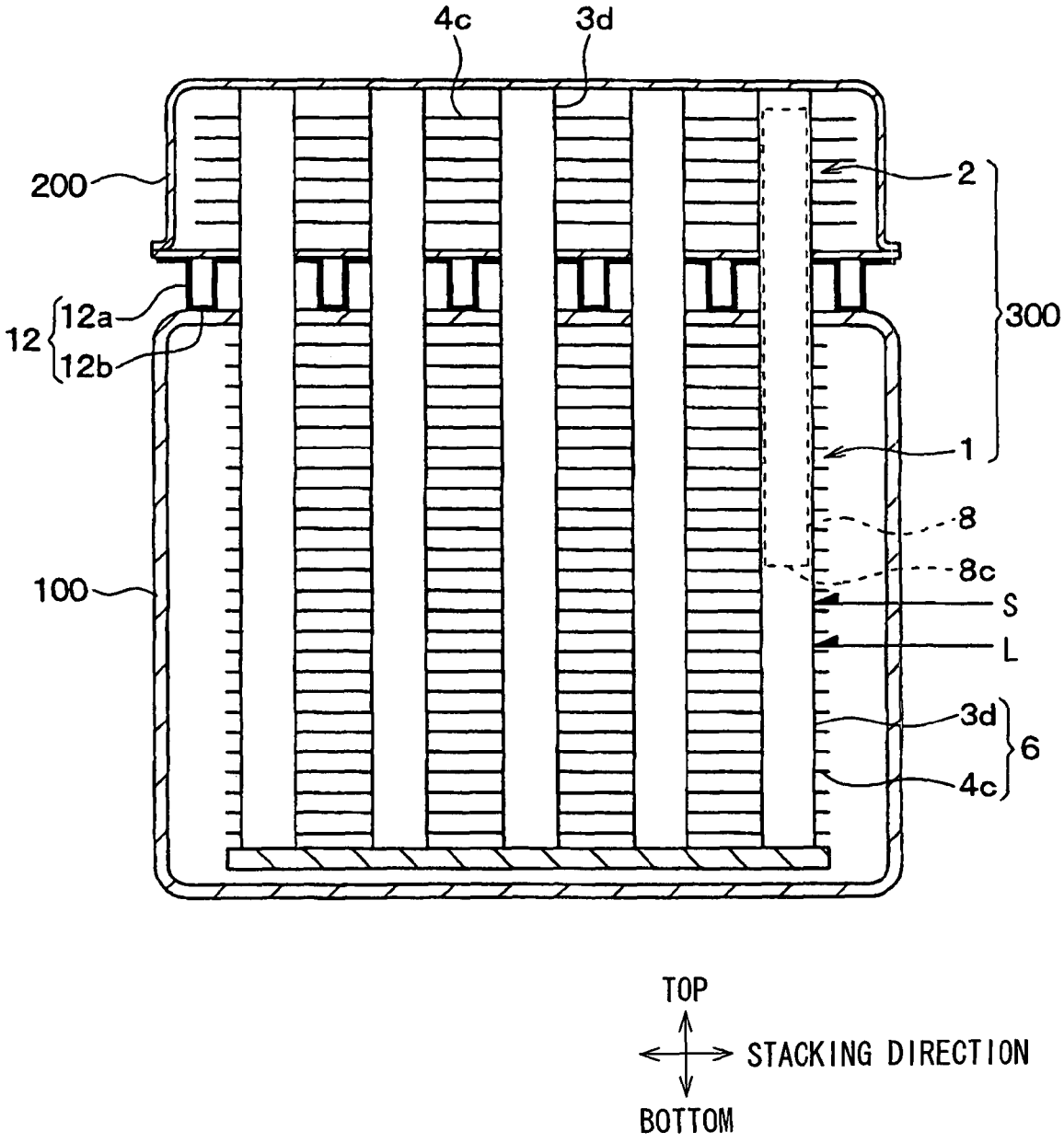
FIG. 6 is a schematic front view showing a heat-pipe type heat exchanger when being viewed from an upstream side of exhaust gas, according to a third embodiment of the present invention.

A third embodiment of the present invention will be now described with reference to FIG. 6. FIG. 6 shows a heat exchanger 300 according to the third embodiment. In the heat exchanger 300 of FIG. 6, the parts having the same functions as those of the first embodiment are indicated by the same reference numbers.

In the third embodiment, the heat exchanger 300 is a siphon-type heat exchanger in which a working fluid is circulated in heat pipes closed at two ends. As shown in FIG. 6, the heat exchanger 300 of the third embodiment includes plural heat pipes 3*d* each of which is a hollow cylindrical shape and is closed at its two longitudinal ends. Inside the heat pipes 3*d*, a working fluid (e.g., water) is sealed to be evaporated and condensed.

In this embodiment, plural heat pipes 3*d* are arranged in parallel to extend in a vertical direction. A first box 100 for passing through exhaust gas discharged from an engine is located at a lower area of the heat pipes 3*d* in the vertical direction. That is, a part of the heat pipes 3*d*, positioned on a lower side, is located inside the first box 100, and a part of the heat pipes 3*d*, positioned on an upper side, is located inside a second box 200. Plural plate fins 4*c* are joined to the outer surfaces of the heat pipes 3*d*, as shown in FIG. 6. In this embodiment, the heat pipes 3*d* and the plate fins 4*c* are alternatively stacked in a stacking direction that is perpendicular to a longitudinal direction (e.g., vertical direction) of the heat pipes 3*d*.

Inner fins 8 are located inside the heat pipes 3*d* at a position above a predetermined position. Similarly to the above-described first embodiment, the inner fins 8 are located in the heat pipes 3*a*, such that the bottom ends of the inner fins 8 are positioned upper than the top surface position L of the working fluid in the liquid state, and upper than the top surface position S of the working fluid in the solid state.

Heat transmission fins 12 (heat transmission member) are located between the first box 100 and the second box 200 to partially contact both the first and second boxes 100, 200. The heat transmission fin 12 includes flat plate portion 12*a*, and a tip portion 12*b* located between adjacent two flat plate portions 12*a* to separate the adjacent two flat plate portions 12*a* by a predetermined distance. The tip portion 12*b* is bent from the flat plate portion 12*a* approximately by a right angle, for example. The tip portions 12*b* of the heat transmission fins 12 are joined to the first box 100 and the second box 200 to partially contact the first box 100 and the second box 200. Therefore, heat can be transmitted between the first box 100 and the second box 200 via the heat transmission fins 12.

According to the heat exchanger 300 of the third embodiment, while the exhaust gas passes through the evaporation portion 1, the liquid working fluid staying in the lower portion of the heat pipes 3*d* is evaporated by absorbing heat from the exhaust gas, and the evaporated vapor working fluid moves upwardly to the upper portion of the heat pipes 3*d*. The vapor working fluid flowing into the upper portion of the heat pipes 3*d* within the second box 200 is cooled and condensed by engine-cooling water, and the condensed liquid working fluid flows downwardly to return into the lower portion of the heat pipes 3*d*.

In a case where the exhaust gas does not pass through the evaporation portion 1, if the outside air temperature becomes lower than the freeze temperature of the working fluid, the working fluid staying at the lower portion in the heat pipes 3*d* is solidified.

At a solidification start time of the working fluid, because the top surface of the working fluid does not contact the inner fins 8, the heat transmission is slowly performed, and the solidification of the working fluid at its top surface becomes later. In contrast, at the portions contacting the heat pipes 3*d*, the working fluid solidifies relatively early as compared with the top surface of the working fluid. Therefore, the timing, at which the top surface of the working fluid is solidified to be closed, becomes later. As a result, at the time where the top surface of the working fluid is closed, an amount of the liquid working fluid closed and sealed by solid working fluid becomes smaller, thereby reducing an inner pressure due to the solidification of the liquid working fluid. Thus, the durability of the heat exchanger 300 can be improved, similarly to the above-described first embodiment.

According to the third embodiment, the bottom ends 8*c* of the inner fins 8 are positioned upper than the top surface position S of the working fluid at the solid state. Thus, even when the top surface of the working fluid increases in accordance with the solidification of the working fluid, the top surface of the working fluid does not contact the inner fins 8. Because the top surface of the working fluid does not contact the inner fins 8, the solidification of the working fluid at the top surface can be made relatively slowly as compared with a case where the top surface of the working fluid contacts the inner fins 8.

Fourth Embodiment

Figure 7:
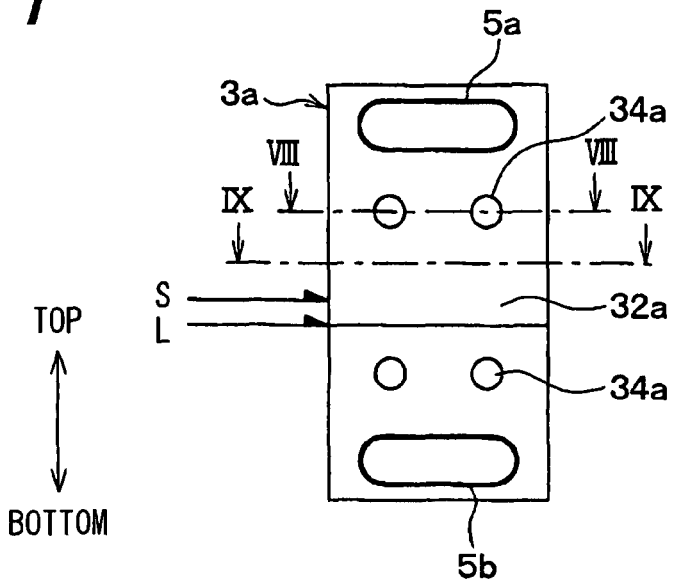
FIG. 7 is a side view showing an evaporation side heat pipe in a heat exchanger according to a fourth embodiment of the present invention.

A fourth embodiment of the present invention will be now described with reference to FIGS. 7 to 9. In the fourth embodiment, the parts having the same functions as those of the first embodiment are indicated by the same reference numbers. FIG. 7 is a side view showing an evaporation side heat pipe 3*a* in a heat exchanger 300 according to the fourth embodiment.

In the above-described first embodiment, the evaporation side heat pipe 3*a* is provided with the inner fin 8 at a position higher than a predetermined position above the top surface position S of the working fluid. In the fourth embodiment, instead of the inner fins, ribs are provided in the evaporation side heat pipes 3*a*.

Figure 8:
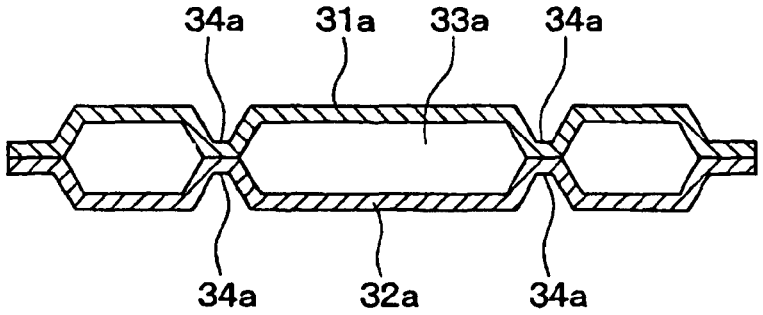
FIG. 8 is a cross-sectional view taken along the line VIII-VIII in FIG. 7.
Figure 9:
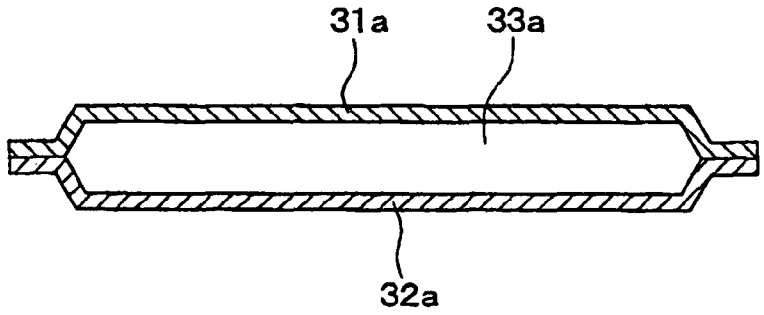
FIG. 9 is a cross-sectional view taken along the line IX-IX in FIG. 7.

As shown in FIGS. 7 to 9, the evaporation side heat pipe 3*a* is constructed with a flat first plate 31*a* and a flat second plate 32*a* which are arranged opposite to each other. The outer periphery of the first and second plates 31*a*, 32*a* are bonded by brazing to form an inner fluid passage 33*a* so that a working fluid flows in the inner fluid passage 33*a*.

A plurality of ribs 34*a* are formed in the first and second plates 31*a*, 32*a* to protrude into the inner fluid passage 33*a*. The ribs 34*a* can be formed such that top ends of the ribs 34*a* provided on the first plate 31*a* are joined to top ends of the ribs 34*a* provided on the second plate 31*a*, as shown in FIG. 8, for example.

Because the ribs 34*a* are formed to partially contact the first and second plates 31*a*, 32*a*, the brazing performance of a stacked member formed by stacking the evaporation side heat pipes 3*a* and the corrugated fins 4*a* (see FIG. 1) can be improved, thereby improving the pressure-resistance strength in the heat exchanger 300. For example, the rib 34*a* may have a round shape when being viewed from a side surface of the evaporation side heat pipe 3*a*, as shown in FIG. 7. However, the protruding shape of the rib 34*a* may be formed into the other shapes.

Plural ribs 34*a* are arranged to be separated from each other in a flow direction of exhaust gas (right-left direction of FIG. 7), and are positioned between two ends of the evaporation side heat pipe 3*a* in the flow direction of exhaust gas. In addition, the ribs 34*a* are arranged at positions away from the top surface of the working fluid to be separated from each other in the vertical direction (longitudinal direction of the evaporation side heat pipe 3*a*). That is, the ribs 34*a* are located at positions above the top surface position L of the working fluid in the liquid state, and above the top surface position S of the working fluid in the solid state. In addition, another ribs 34*a* are located at positions lower than the top surface position L of the working fluid in the liquid state.

FIG. 8 is a cross-sectional view taken along the line VIII-VIII in FIG. 7, and FIG. 9 is a cross-sectional view taken along the line IX-IX in FIG. 7. In this example, the ribs 34*a* are located in the evaporation side heat pipes 3*a* such that the ribs 34*a* are positioned upper than the top surface position S of the working fluid in the solid state, and lower than the top surface position L of the working fluid in the solid state. However, the ribs 34*a* positioned lower than the top surface position L of the working fluid may be omitted. In the heat exchanger 300 of the fourth embodiment, the other parts may be similar to those of the above-described first embodiment.

According to the fourth embodiment, in a case where the exhaust gas does not pass through the evaporation portion 1, if the outside air temperature becomes lower than the freeze temperature of the working fluid, the working fluid staying at the lower portion in the heat pipes 3*a* and the lower communication portion 5*b* is solidified.

At a solidification start time of the working fluid, because the top surface of the working fluid does not contact any the ribs 34*a*, the heat transmission is slowly performed, and the solidification of the working fluid at its top surface becomes later. In contrast, at the portions contacting the heat pipes 3*a* and the lower communication portion 5*b*, the working fluid solidifies relatively early as compared with the top surface of the working fluid. Therefore, the timing, at which the top surface of the working fluid is solidified to be closed, becomes later. As a result, at the time where the top surface of the working fluid is closed by the solid working fluid, an amount of the liquid working fluid closed and sealed by solid working fluid becomes smaller, thereby reducing an inner pressure due to the solidification of the liquid working fluid. Thus, the durability of the heat exchanger 300 can be improved, similarly to the above-described first embodiment.

According to the fourth embodiment, the ribs 34*a* are positioned above the top surface position L of the working fluid at the liquid state, and above the top surface position S of the working fluid at the solid state. Thus, even when the top surface of the working fluid rises in accordance with the solidification of the working fluid, the top surface of the working fluid does not contact the ribs 34*a*. Because the top surface of the working fluid does not contact the ribs 34*a*, the solidification of the working fluid at the top surface can be made relatively slowly as compared with a case where the top surface of the working fluid contacts the ribs 34*a*.

Figure 10A:
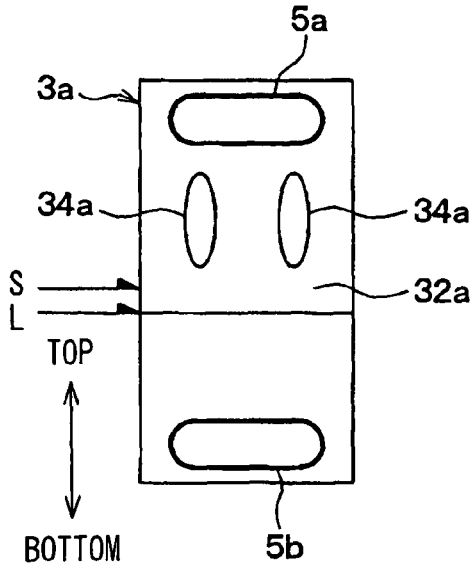
FIGS. 10A and 10B are side views each showing an evaporation side heat pipe in a heat exchanger according to modifications of the fourth embodiment.
Figure 10B:
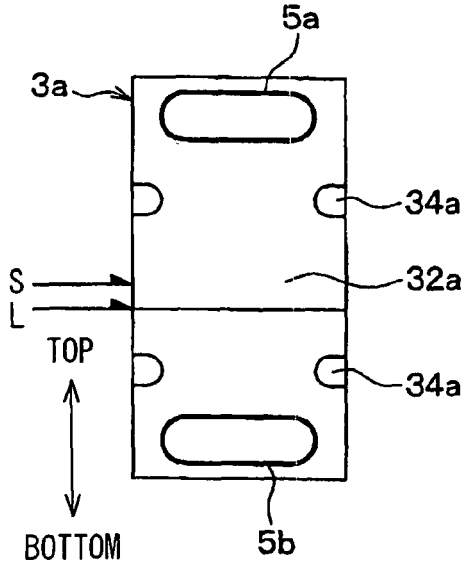
Figure 11:
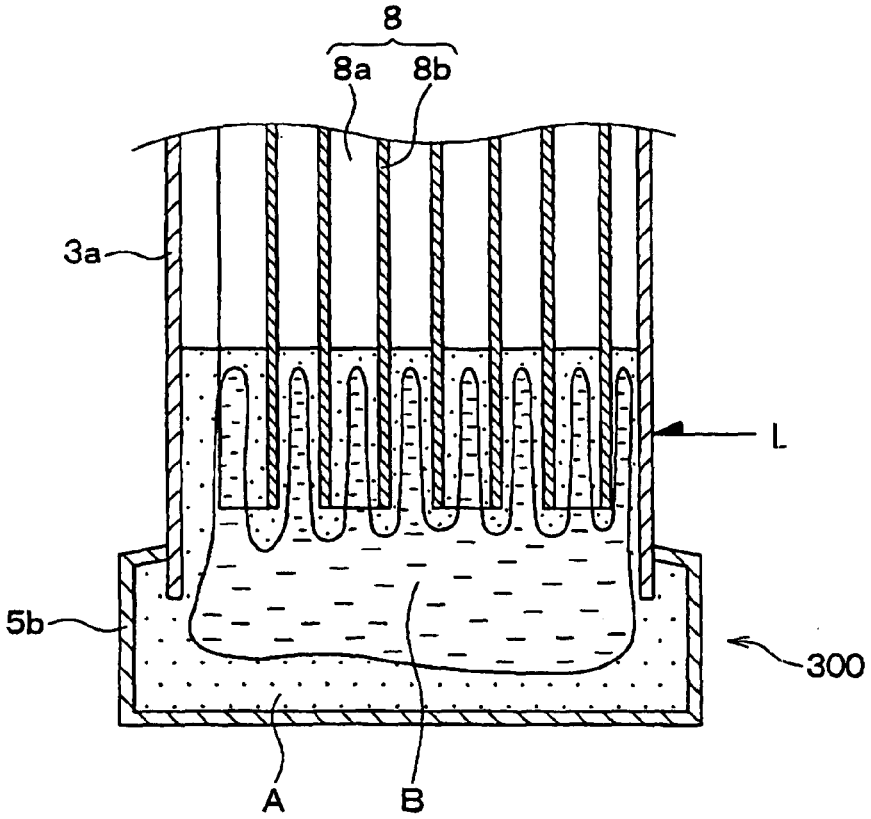
FIG. 11 RELATED ART
FIG. 11 is a schematic cross-section view showing a heat exchanger in a related art.

The shapes and the positions of the ribs 34*a* formed in the evaporation side heat pipe 3*a* may be suitably changed without being limited to the ribs 34*a* shown in FIGS. 7 and 8. For example, the rib 34*a* may have an elliptic shape as shown in FIG. 10A, or may be formed at the ends of the evaporation side heat pipe 3*a* in the flow direction (right-left direction of FIGS. 10A and 10B) of the exhaust gas. In the structure of FIG. 10B, the ribs 34*a* are partially arranged above the top surface position S of the working fluid in the solid state and below the top surface position L of the working fluid in the liquid state.

Furthermore, when the evaporation side heat pipes 3*a* and the condensation side heat pipes 3*b* are arranged in parallel to each other as in the first embodiment, the condensation side heat pipes 3*b* may have the same structure as that of the evaporation side heat pipes 3*a*.

For example, similarly to the evaporation side heat pipe 3*a*, the condensation side heat pipe 3*b* is constructed with a flat first plate and a flat second plate which are arranged opposite to each other. The outer periphery of the first and second plates for the condensation side heat pipe 3*b* are bonded by brazing to form a condensation-side inner fluid passage so that the working fluid flows in the condensation-side inner fluid passage.

A plurality of ribs are formed in the first and second plates in the condensation side heat pipe 3*b* to protrude into the condensation-side inner fluid passage. The ribs can be formed in the condensation side heat pipe 3*b* such that top ends of the ribs provided on the first plate are joined to top ends of the ribs provided on the second plate. In addition, the ribs are arranged above the top surface of the working fluid in the vertical direction (longitudinal direction of the condensation side heat pipe 3*b*). Specifically, the ribs are located in upper portions of the condensation side heat pipes 3*b* in the vertical direction, such that the ribs are positioned upper than the top surface position L of the working fluid in the liquid state, and upper than the top surface position S of the working fluid in the solid state. Furthermore, the ribs may be also located in lower portions of the condensation side heat pipes 3*b* in the vertical direction such that the ribs are positioned lower than the top surface L of the working fluid in the liquid state.

Thus, at a solidification start time of the working fluid, because the top surface of the working fluid does not contact the ribs in the heat pipes 3*b*, 3*b*, the heat transmission can be slowly performed, and the solidification of the working fluid at its top surface becomes later. Therefore, at the time where the top surface of the working fluid is closed, an amount of the liquid working fluid closed and sealed by solid working fluid becomes smaller, thereby reducing an inner pressure due to the solidification of the liquid working fluid. Thus, the durability of the heat exchanger 300 can be improved.

Other Embodiments

Although the present invention has been fully described in connection with the preferred embodiments thereof with reference to the accompanying drawings, it is to be noted that various changes and modifications will become apparent to those skilled in the art.

For example, the rib structure of the heat pipe 3*a* described in the fourth embodiment or the rib structure of the heat pipe 3*a* described in the modifications (FIGS. 10A and 10B) of the fourth embodiment may be used instead of the inner fin structure of the heat pipe 3*a* described in the second embodiment, or instead of the inner fin structure of the heat pipe 3*d* described in the third embodiment. That is, the rib structure provided in the heat pipe 3*a* described in the fourth embodiment or the modifications of the fourth embodiment may be suitably used instead of the inner fin structure of the above-described embodiments. Furthermore, a combination of heat pipe structures described in the above embodiments may be used.

In the above-described embodiments, the longitudinal direction of the heat pipes 3*a*, 3*b*, 3*d* is positioned in the vertical direction. However, the longitudinal direction of the heat pipes 3*a*, 3*b*, 3*d* can be inclined relative to the vertical direction. Only when the condensed working fluid can be made to stay in a lower portion of the heat pipes 3*a*, 3*b*, 3*d* without being horizontally extended, the longitudinal direction of the heat pipes 3*a*, 3*b*, 3*d* may be suitably inclined relative to the vertical direction. That is, when the longitudinal direction of the heat pipes 3*a*, 3*b*, 3*d* is inclined relative to the horizontal direction or is perpendicular to the horizontal direction, it is possible for the condensed working fluid to stay in the lower portion of the heat pipes 3*a*, 3*b*, 3*d*. Only when the working fluid flows through the heat pipes 3*a*, 3*b*, 3*d* in a direction different from the horizontal direction, the arrangement of the heat pipes 3*a*, 3*b*, 3*d* can be suitably changed.

In the above-described embodiment, the working fluid may be suitably changed to any fluid normally used for evaporating and condensing. Furthermore, as a heating source for heating the working fluid in the evaporation portion 1, other high-temperature fluid can be suitably used instead of the exhaust gas of the engine. In addition, as the low-temperature fluid for radiating heat from the working fluid in the condensation portion 2, a fluid other than the engine-cooling water may be used. For example, as the low-temperature fluid, an engine oil, an inverter cooling water, etc. may be used.

In the above-described embodiment, as a heat-transmission area increasing member for increasing a heat transmission area of the heat pipe 3*a*, 3*b*, 3*c*, the inner fins 8 or the ribs 34*a* are used. However, the structure of the heat-transmission area increasing member is not limited to that, and can be suitably changed in accordance with the shape of the heat pipe 3*a*, 3*b*, 3*d* only when the heat-transmission area increasing member is located at a position separated from a top surface position L of the working fluid in the liquid state. More preferably, the heat-transmission area increasing member is positioned in the heat pipe 3*a*, 3*b*, 3*c* above the top surface position S of the working fluid in the solid state, or under the top surface position L of the working fluid in the liquid state.

Such changes and modifications are to be understood as being within the scope of the present invention as defined by the appended claims.

What is claimed is:

1. A heat exchanger comprising:

an evaporation side heat pipe in which a working fluid flowing therein is heat exchanged with an exterior high-temperature fluid passing therethrough to be evaporated;

a condensation side heat pipe in which the working fluid flowing therein is heat exchanged with an exterior low-temperature fluid passing therethrough to be condensed; and an evaporation side inner fin located in the evaporation side heat pipe to increase a heat transmission area of the evaporation side heat pipe with the working fluid, wherein:

the evaporation side heat pipe and the condensation side heat pipe are connected to form a closed cycle in which the working fluid circulates between the evaporation side heat pipe and the condensation side heat pipe;

the evaporation side heat pipe is arranged such that the working fluid flows in the evaporation side heat pipe in a direction different from a horizontal direction; and the evaporation side inner fin located in the evaporation side heat pipe has a bottom end that is positioned above a top surface of the working fluid in a liquid state.

2. The heat exchanger according to claim 1, wherein the evaporation side heat pipe and the condensation side heat pipe are arranged in an arrangement direction that is approximately parallel to the horizontal direction, and the condensation side heat pipe is arranged such that the working fluid flows in the condensation side heat pipe in a direction different from the horizontal direction, the heat exchanger further comprising a condensation side inner fin located in the condensation side heat pipe to increase a heat transmission area of the condensation side heat pipe with the working fluid, wherein the condensation side inner fin located in the condensation side heat pipe has a bottom end that is positioned above a top surface of the working fluid in the liquid state within the condensation side heat pipe.

3. The heat exchanger according to claim 2, wherein the bottom end of the inner fin is positioned above a top surface of the working fluid in a solid state.

4. The heat exchanger according to claim 1, wherein the bottom end of the inner fin is positioned above a top surface of the working fluid in a solid state.

5. The heat exchanger according to claim 1, wherein the working fluid is water.

6. The heat exchanger according to claim 1, wherein the high-temperature fluid is exhaust gas discharged from a water-cooled engine, and the low-temperature fluid is water for cooling the engine.

7. The heat exchanger according to claim 1, wherein the evaporation side heat pipe is formed into a flat shape in a cross-section having a major dimension in a direction corresponding to a flow direction of the exterior high-temperature fluid.

8. The heat exchanger according to claim 1, wherein the evaporation side inner fin is located closer to an upper side of the evaporation side heat pipe relative to a lower side of the evaporation side heat pipe.

9. A heat exchanger comprising:

a heat pipe elongated in a longitudinal direction and closed at longitudinal ends, the heat pipe having a working fluid sealed therein; and an inner fin located in a first portion of the heat pipe to increase a heat transmission area of the heat pipe with the working fluid, wherein:

the first portion is on one side of the longitudinal direction, and a second portion is on the other side of the longitudinal direction;

the first portion of the heat pipe is located to evaporate the working fluid by heat-exchanging between the working fluid and an exterior high-temperature fluid;

the second portion of the heat pipe is located to condense the evaporated working fluid;

the heat pipe is arranged such that the working fluid flows in the heat pipe in a direction different from a horizontal direction; and the inner fin located in the heat pipe has a bottom end that is positioned above a top surface of the working fluid in a liquid state.

10. The heat exchanger according to claim 9, wherein the bottom end of the inner fin is positioned above a top surface of the working fluid in a solid state.

11. The heat exchanger according to claim 9, wherein the heat pipe is a straight pipe.

12. The heat exchanger according to claim 9, wherein the heat pipe is a hollow cylindrical shape.

13. The heat exchanger according to claim 9, wherein the inner fin is located closer to an upper side of the heat pipe relative to a lower side of the heat pipe.

14. A heat exchanger comprising:

an evaporation side heat pipe in which a working fluid flowing therein is heat exchanged with an exterior high-temperature fluid passing therethrough to be evaporated; and a condensation side heat pipe in which the lower working fluid flowing therein is heat exchanged with an exterior low-temperature fluid passing therethrough to be condensed, wherein:

the evaporation side heat pipe and the condensation side heat pipe are connected to form a closed cycle in which the working fluid circulates between the evaporation side heat pipe and the condensation side heat pipe;

the evaporation side heat pipe is arranged such that the working fluid flows in the evaporation side heat pipe in a direction different from a horizontal direction;

the evaporation side heat pipe includes a first flat plate, a second flat plate opposite to the first flat plate to form an inner fluid passage between the first flat plate and the second flat plate, in which the working fluid flows, and ribs provided in the first flat plate and the second flat plate to protrude into the inner fluid passage;

the ribs of the first flat plate and the second flat plate, opposite to each other, are joined to each other at top ends of the ribs; and the ribs are positioned above a top surface of the working fluid in a liquid state.

15. The heat exchanger according to claim 14, wherein:

the evaporation side heat pipe and the condensation side heat pipe are arranged in an arrangement direction that is approximately parallel to the horizontal direction;

the condensation side heat pipe is arranged such that the working fluid flows in the condensation side heat pipe in a direction different from the horizontal direction;

the condensation side heat pipe includes a first flat plate, a second flat plate opposite to the first flat plate to form an inner fluid passage between the first flat plate and the second flat plate, in which the working fluid flows, and ribs provided in the first flat plate and the second flat plate to protrude into the inner fluid passage;

the ribs of the first flat plate and the second flat plate of the condensation side heat pipe, opposite to each other, are joined to each other at top ends of the ribs; and the ribs of the condensation side heat pipe are positioned above a top surface of the working fluid in the liquid state.

16. The heat exchanger according to claim 15, wherein the ribs are positioned above a top surface of the working fluid in a solid state.

17. The heat exchanger according to claim 14, wherein the ribs are positioned above a top surface of the working fluid in a solid state.

18. The heat exchanger according to claim 14, wherein the ribs are provided on an upper side of the first flat plate and second flat plate, relative to a lower side of the first flat plate and second flat plate.

19. A heat exchanger comprising:

a heat pipe elongated in a longitudinal direction and closed at longitudinal ends, the heat pipe having a working fluid sealed therein, wherein:

the heat pipe has a first portion on one side of the longitudinal direction, and a second portion on the other side of the longitudinal direction;

the first portion of the heat pipe is located to evaporate the working fluid by heat-exchanging between the working fluid and an exterior high-temperature fluid;

the second portion of the heat pipe is located to condense the evaporated working fluid;

the heat pipe is arranged such that the working fluid flows in the heat pipe in a direction different from a horizontal direction;

the heat pipe includes a first flat plate, a second flat plate opposite to the first flat plate to form an inner fluid passage between the first flat plate and the second flat plate, in which the working fluid flows, and ribs provided in the first flat plate and the second flat plate to protrude into the inner fluid passage;

the ribs of the first flat plate and the second flat plate, opposite to each other, are joined to each other at top ends of the ribs; and the ribs are positioned at an upper side of the heat pipe relative to a lower side of the heat pipe to be above a top surface of the working fluid in a liquid state.

20. The heat exchanger according to claim 19, wherein the ribs are positioned above a top surface of the working fluid in a solid state.

21. A heat exchanger in which a working fluid circulates, the heat exchanger comprising:

an evaporation portion located to heat and evaporate the working fluid; and a condensation portion located to liquefy and condense the evaporated working fluid, wherein:

the evaporation portion includes a plurality of heat pipes in which the working fluid flows;

the evaporation portion and the condensation portion are connected to form a closed cycle in which the working fluid circulates between the evaporation portion and the condensation portion;

the heat pipes are arranged such that the working fluid flows in the heat pipes in a direction different from a horizontal direction;

the evaporation portion further includes a heat-transmission area increasing member located in the heat pipe to increase a heat transmission area of the heat pipe with the working fluid; and the heat-transmission area increasing member is located at a position separated from a top surface of the working fluid in a liquid state in a vertical direction.

22. The heat exchanger according to claim 21, wherein the heat-transmission area increasing member is located in the heat pipe at a position upper than a top surface of the working fluid in a solid state, or lower than the top surface of the working fluid in the liquid state.

23. The heat exchanger according to claim 21, wherein the heat-transmission area increasing member is an inner fin located inside the heat pipe.

24. The heat exchanger according to claim 21, wherein the heat-transmission area increasing member is constructed of ribs protruding from an inner wall surface of the heat pipe to an inside of the heat pipe.

25. The heat exchanger according to claim 21, wherein the heat-transmission area increasing member is located at an upper side of the heat pipe relative to a lower side of the heat pipe.

* * * * *